US006624715B2

(12) United States Patent
Yuanzhu

(10) Patent No.: US 6,624,715 B2
(45) Date of Patent: Sep. 23, 2003

(54) ULTRAWIDE-BAND LINEAR-CIRCULAR POLARIZATION CONVERTER

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/536,956

(22) Filed: Mar. 28, 2000

(65) Prior Publication Data

US 2003/0080821 A1 May 1, 2003

(30) Foreign Application Priority Data

Mar. 30, 1999 (JP) ..... 11-089960

(51) Int. Cl.[7] ..... H01P 5/12
(52) U.S. Cl. ..... 333/21 A; 333/135; 333/157
(58) Field of Search ..... 333/21 A, 135, 333/157, 248

(56) References Cited

U.S. PATENT DOCUMENTS

| | | | |
|---|---|---|---|
| 4,100,514 | A | 7/1978 | DiTullio et al. |
| 4,344,048 | A | 8/1982 | Mörz |
| 4,672,334 | A | 6/1987 | Saad |

FOREIGN PATENT DOCUMENTS

| | | |
|---|---|---|
| EP | 00 30 2503 | 6/2000 |
| GB | 720153 | 12/1954 |
| JP | 7-142901 | 7/1995 |

OTHER PUBLICATIONS

XP–002138855; International Journal of Electronics, Circularly Polarized Elliptical Beamshape Horn Antennas; (28 pages), Aug. 1982.

Alliance for Telecommunications Industry Solutions, *Phase Delay*, available at http://www.atis.org/home.htm and http://www.atis.org/tg2k/_phase_delay.html., pp. 1–4, printed on Feb. 5, 2003 and Feb. 13, 2003.

AML Wireless Systems, *Glossary of Terms*, available at http://www.amlwireless.com/list.htm, pp. 1–34, printed on Feb. 5, 2003.

Alliance for Telecommunications Industry Solutions, *Phase Delay*, available at http://www.atis.org/home.htm and http://www.atis.org/tg2k/_phase_delay.html., pp. 1–4, printed on Feb. 5, 2003 and Feb. 13, 2003.

AML Wireless Systems, *Glossary of Terms*, available at http://www.amlwireless.com/list.htm, pp. 1–34, printed on Feb. 5, 2003.

*Primary Examiner*—Robert Pascal
*Assistant Examiner*—Kimberly E Glenn
(74) *Attorney, Agent, or Firm*—Brinks Hofer Gilson & Lione

(57) ABSTRACT

In an ultrawide-band linear-circular polarization converter, in a noncircular waveguide which has negative-phase characteristics in which a phase gradually decreases in accordance with an increase in a frequency over an ultrawide-band frequency range, a dielectric structure which has positive-phase characteristics, in which a phase gradually increases in accordance with an increase in a frequency, having a complementary relationship with the negative-phase characteristics in the ultrawide-band frequency range is provided.

9 Claims, 5 Drawing Sheets

ULTRAWIDE-BAND LINEAR-CIRCULAR POLARIZATION CONVERTER

BACKGROUND OF THE INVENTION

1. Field of the Invention

The present invention relates to ultrawide-band linear-circular polarization converters, and more particularly relates to an ultrawide-band linear-circular polarization converter which has a noncircular waveguide including a dielectric structure and which is set so that frequency-versus-phase characteristics of the noncircular waveguide and those of the dielectric structure complement each other in a range of the ultrawide-band.

2. Description of the Related Art

Hitherto, in a transmitter-receiver which transmits or receives a satellite broadcasting having a dual-band or an ultrawide-band circularly polarized signal, an ultrawide-band or wide-band linear-circular polarization converter has been used to convert a circularly polarized signal into a linearly polarized signal, and vice versa.

In this case, the dual-band has two frequency bands among satellite broadcasting frequency band at several giga-hertz, such as a frequency band of 12.2 GHz to 12.7 GHz and a frequency band of 19.7 GHz to 20.2 GHz. The wide-band is a frequency band of, for example, 10.7 GHz to 12.75 GHz among the satellite broadcasting frequency band of the above several giga-hertz.

FIGS. 5A and 5B are cross-sectional views showing a first construction example of a known linear-circular polarization converter, in which FIG. 5A is a cross-sectional view perpendicular to the longitudinal direction and FIG. 5B is a cross-sectional view in the longitudinal direction.

As shown in FIGS. 5A and 5B, in the first construction example of a known linear-circular polarization converter, a circular waveguide 51 has a planar dielectric structure 52 provided so as to be along the direction of one diameter thereof. In this case, the planar dielectric structure 52 is provided so as to be along the direction of one diameter of the circular waveguide 51 which is sloped at approximately 45 degrees to the direction of the internal electric field E of the circular waveguide 51. Both side faces extending in the longitudinal direction of the dielectric structure 52 are cut inwardly in a generally triangular shape.

FIGS. 6A and 6B are cross-sectional views showing a second construction example of a known linear-circular polarization converter, in which FIG. 6A is a cross-sectional view perpendicular to the longitudinal direction and FIG. 6B is a cross-sectional view in the longitudinal direction.

As shown in FIGS. 6A and 6B, in the second construction example of a known linear-circular polarization converter, a ridged conductor structure 62 is provided at a part of the inner wall of a circular waveguide 61. In this case, the ridged conductor structure 62 is provided at a position of the inner wall of the circular waveguide 61 which is sloped at approximately 45 degrees to the direction of the internal electric field E of the circular waveguide 61. In the ridged conductor structure 62, the height of an edge part in the longitudinal direction is lower than that of a central part.

In these linear-circular polarization converters, when a linearly polarized signal is input to an input terminal thereof, a circularly polarized signal can be output from an output terminal thereof, and vice versa.

Generally, linear-circular polarization converters can perform a predetermined linear-circular polarization conversion on a polarized signal propagating through the waveguide in a frequency band which causes the phase difference $|\phi|$ $(=|\phi_V-\phi_H|)$ between the vertical-polarization phase $\phi_V$ of the polarized signal and the horizontal-polarization phase $\phi_H$ thereof to be maintained within a range of 90°±10°.

Since the frequency bands of known linear-circular polarization converters causing the phase difference $|\phi|$ to be maintained within the range of 90°±10° are relatively narrow frequency ranges, known linear-circular polarization converters cannot be used as wide-band linear-circular polarization converters or ultrawide-band linear-circular polarization converters which activate in a broader frequency range than that of the wide-band linear-circular polarization converters.

Since known linear-circular polarization converters only have a relative frequency band of several percent, favorable conversion characteristics cannot be obtained throughout a relative frequency band of the order of ten percent or a relative frequency band of several tens of percent.

SUMMARY OF THE INVENTION

Accordingly, the present invention is made considering such a technical background. It is an object of the present invention to provide an ultrawide-band linear-circular polarization converter for capable of offering favorable frequency-versus-phase characteristics as a linear-circular polarization converter in a frequency range of an ultrawide-band.

To this end, according to a first aspect of the present invention, there is provided an ultrawide-band linear-circular polarization converter in which, in a noncircular waveguide which has negative-phase characteristics in which a phase gradually decreases in accordance with an increase in a frequency over an ultrawide-band frequency range, a dielectric structure which has positive-phase characteristics, in which a phase gradually increases in accordance with an increase in a frequency, having a complementary relationship with the negative-phase characteristics in the ultrawide-band frequency range is provided.

In the ultrawide-band linear-circular polarization converter, the noncircular waveguide may be an elliptic waveguide.

In the ultrawide-band linear-circular polarization converter, the dielectric structure may be provided in the direction of the minor axis of the elliptic waveguide, and the dielectric structure may have edge parts which are thin in the thickness direction and a central part which is thick in the thickness direction.

As described above, according to the present invention, by combining the noncircular waveguide having negative-phase characteristics and the dielectric structure having positive-phase characteristics which complement the negative-phase characteristics, the following advantages are obtained: the ultrawide-band linear-circular polarization converter can be caused to have generally flat frequency-versus-phase characteristics which enable favorable linear-circular polarization conversion to be performed in the ultrawide-band frequency range; and the ultrawide-band linear-circular polarization converter can be obtained, having a simple construction, without causing an increase in manufacturing cost or the like.

DESCRIPTION OF THE PREFERRED EMBODIMENTS

Embodiments of the present invention are described with reference to the accompanying drawings.

Figure 1A:
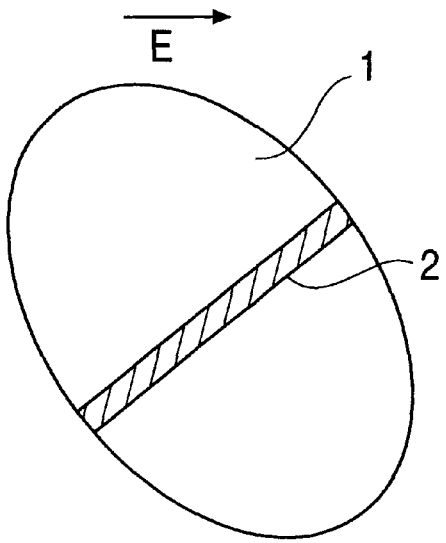
FIGS. 1A, 1B, and 1C are diagrams showing the construction of an ultrawide-band linear-circular polarization converter according to one embodiment of the present invention.
Figure 1B:
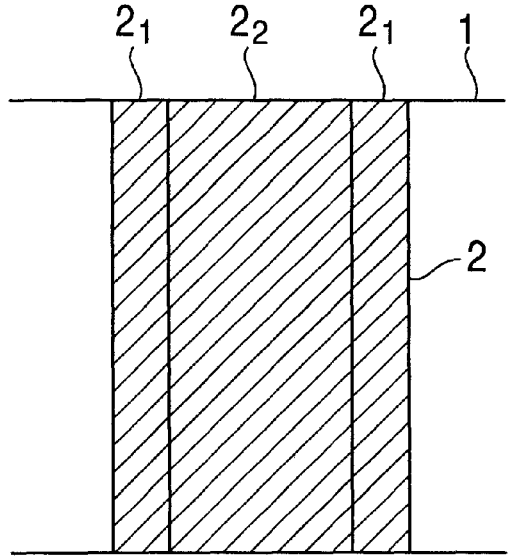
Figure 1C:
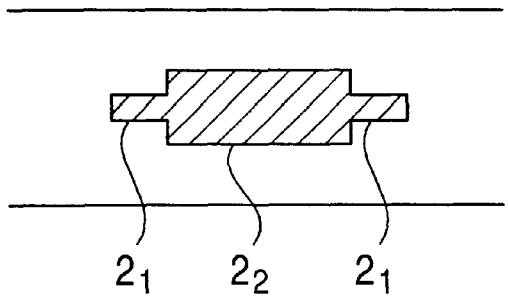

FIGS. 1A, 1B, and 1C show the construction of an ultrawide-band linear-circular polarization converter according to one embodiment of the present invention; FIG. 1A is a cross-sectional view perpendicular to the longitudinal direction; FIG. 1B is a cross-sectional view in the longitudinal direction; and FIG. 1C is a lateral sectional view in the longitudinal direction.

As shown in FIG. 1A to FIG. 1C, the ultrawide-band linear-circular polarization converter according to the present embodiment has an elliptical waveguide 1 (noncircular) and a planar dielectric structure 2 provided along the minor-axis diameter of the elliptical waveguide 1 (noncircular). In this case, the planar dielectric structure 2 in which the plate thickness is thin at edges $\mathbf{2}_1$ and thick at a middle $\mathbf{2}_2$ is constructed. The planar dielectric structure 2 may have another configuration as long as the planar dielectric structure 2 has low reflection characteristics.

Figure 2A:
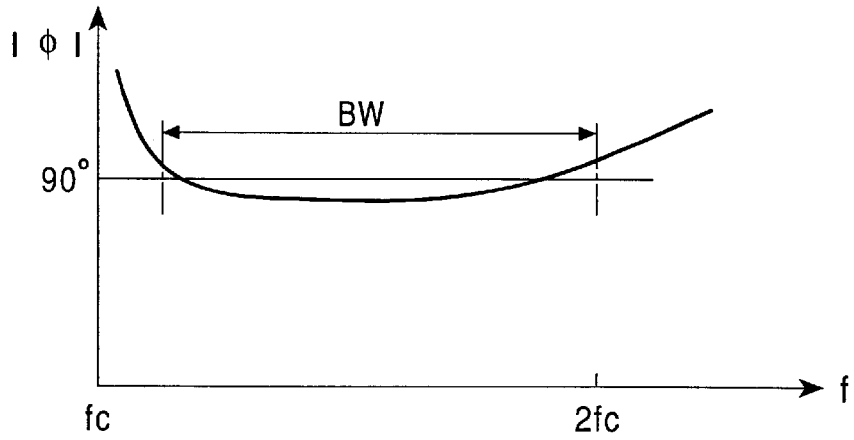
FIGS. 2A, 2B, and 2C are graphs showing frequency-versus-phase characteristics of the ultrawide-band linear-circular polarization converter, a noncircular waveguide, and a dielectric structure, shown in FIGS. 1A, 1B, and 1C.
Figure 2B:
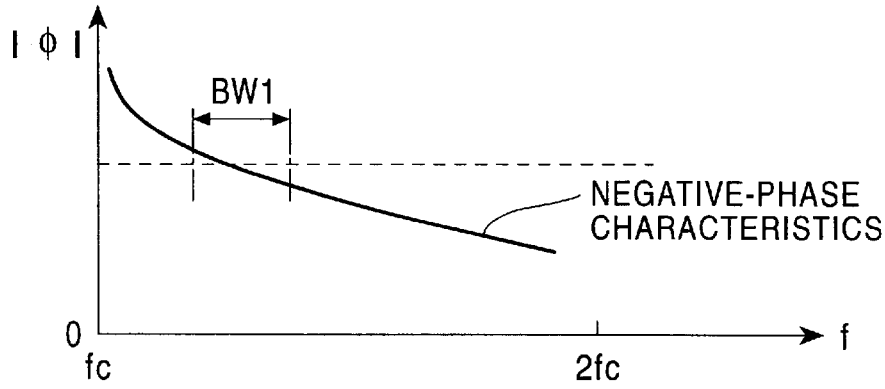

FIG. 2A is a graph showing frequency-versus-phase characteristics of the ultrawide-band linear-circular polarization converter shown in FIGS. 1A to 1C; FIG. 2B is a graph showing frequency-versus-phase characteristics of the noncircular waveguide 1; and FIG. 2C is a graph showing frequency-versus-phase characteristics of the planar dielectric structure 2.

Figure 2C:
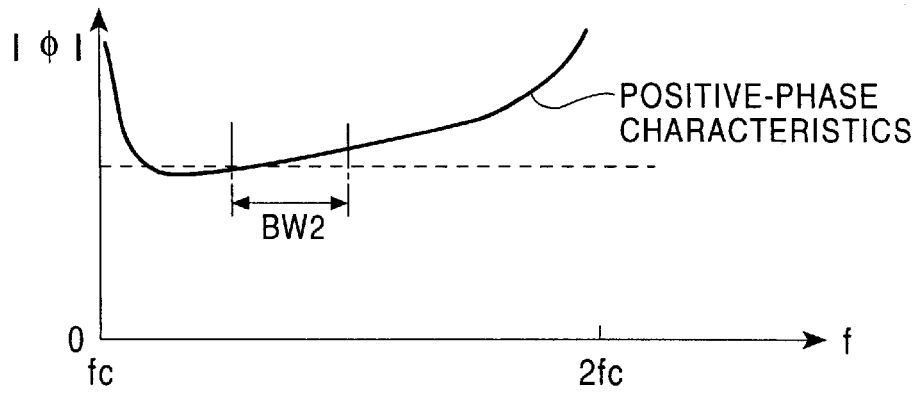

In FIGS. 2A to 2C, the axis of the abscissa represents working frequencies f and the axis of the ordinate represents phase differences $|\phi|$ $(=|\phi_V-\phi_H|)$ in degrees.

As described above, $\phi_V$ is the vertical-polarization phase of the polarized signal propagating through the waveguide, and the $\phi_V$ is the horizontal-polarization phase of the polarized signal propagating through the waveguide.

Operations of the ultrawide-band dielectric linear-circular polarization converter shown in FIGS. 1A to 1C are described with reference to FIGS. 2A to 2C.

Frequency-versus-phase characteristics of the noncircular waveguide 1 alone are as shown in FIG. 2B. In the frequency range of an ultrawide-band between a frequency $f_C$ and a frequency $2f_C$, as a frequency f increases from the frequency $f_C$ toward the frequency $2f_C$, the phase difference $|\phi|$ drops comparatively rapidly in the proximity of the frequency $f_C$. In a subsequent frequency range, the phase difference $|\phi|$ drops slowly and becomes less than ninety degrees while dropping. Subsequently, the phase difference $|\phi|$ continues to drop at the same rate. In this case, a frequency range BW1 in which the phase difference $|\phi|$ is maintained within a range of 90°±10° is limited to a very small part of the frequency range between the frequency $f_C$ and the frequency $2f_C$.

Frequency-versus-phase characteristics of the dielectric structure 2 alone are as shown in FIG. 2C. In the frequency range of the ultrawide-band between the frequency $f_C$ and the frequency $2f_C$, as the frequency f increases from the frequency $f_C$ toward the frequency $2f_C$, the phase difference $|\phi|$ rapidly drops in the proximity of the frequency $f_C$. After the phase difference $|\phi|$ drops below ninety degrees, the phase difference $|\phi|$ starts to gradually increase. When the phase difference $|\phi|$ exceeds ninety degrees and reaches a frequency range which is in the proximity of the frequency $2f_C$, the phase difference $|\phi|$ increases comparatively rapidly. In this case as well, a frequency range BW2 in which the phase difference $|\phi|$ is maintained within the range of 90°±10° is limited to a very small part of the frequency range of the ultrawide-band between the frequency $f_C$ and the frequency $2f_C$.

As shown in FIG. 2A, frequency-versus-phase characteristics of an ultrawide band linear-circular polarization converter constructed by combining the noncircular waveguide 1 and the dielectric structure 2 have phase characteristics obtained by combining negative-phase characteristics in which, as shown in FIG. 2B, the phase difference gradually decreases in accordance with an increase in the frequency in the noncircular waveguide 1, and positive-phase characteristics in which, as show in FIG. 2C, the phase difference gradually increases in accordance with an increase of the frequency in the dielectric structure 2. By constructing the noncircular waveguide 1 and the dielectric structure 2 so that the above negative-phase characteristics and the above positive-phase characteristics are complementary in an ultrawide-band frequency range BW between the proximity of the frequency $f_C$ and that of the frequency $2f_C$, substantially flat phase characteristics can be obtained. To be concrete, the phase difference $|\phi|$ is maintained within the range of 90°±10°. As a result of this, this ultrawide-band linear-circular polarization converter enables favorable conversion characteristics to be achieved over the ultrawide-band frequency range BW.

When a linearly polarized signal is input to an input terminal of this ultrawide-band frequency linear-circular polarization converter, a circularly polarized signal is output from an output terminal of the ultrawide-band frequency linear-circular polarization converter where the linearly polarized signal is converted into the circular polarized signal, and vice versa. A predetermined linear-circular polarization conversion can be applied to a polarized signal over the ultrawide band frequency range BW.

FIGS. 3A, 3B, 3C, and 3D are cross-sectional views showing construction examples of other noncircular waveguides in which the above negative-phase characteristics can be obtained over the ultrawide band frequency range BW.

Figure 3A:
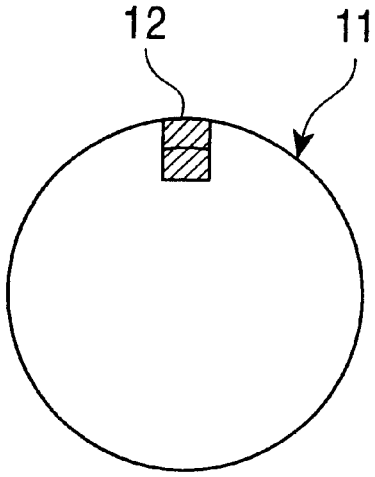
FIGS. 3A, 3B, 3C, and 3D are cross-sectional views showing the constructions of other noncircular waveguides in which positive-phase characteristics can be obtained in an ultrawide-band frequency range.
Figure 3B:
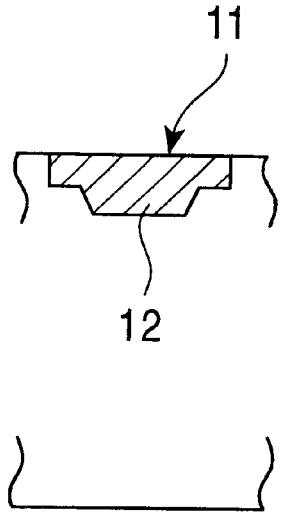

In this case, a noncircular waveguide 11 shown in FIGS. 3A and 3B is constructed by providing a ridged conductor structure 12 at the inner wall thereof.

Figure 3C:
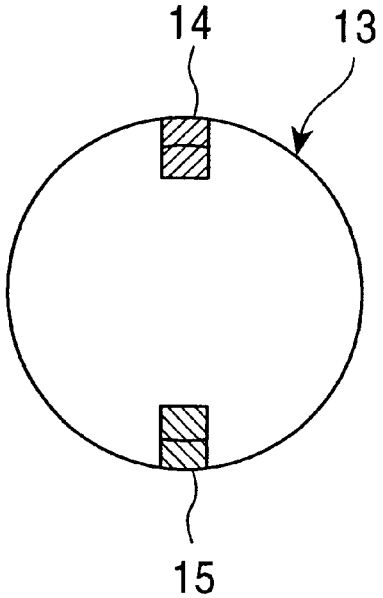
Figure 3D:
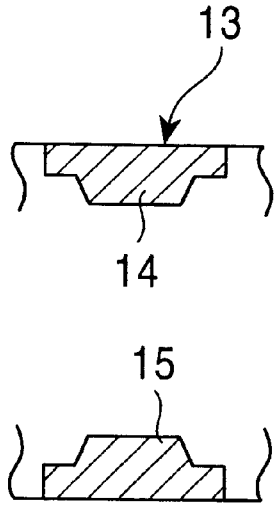

A noncircular waveguide 13 shown in FIGS. 3C and 3D is constructed by providing ridged conductor structures 14 and 15 at parts of the inner wall thereof which face each other.

Instead of using the elliptic (noncircular) waveguide 1 as shown in FIG. 1A, by using the noncircular waveguide 11 or 13 having the construction shown in FIG. 3A or 3C, the negative-phase characteristics shown in FIG. 2B may be also obtained over the ultrawide band frequency range BW.

FIGS. 4A, 4B, 4C, and 4D are cross-sectional views showing construction examples of other planar dielectric structures in which the above positive-phase characteristics can be obtained over the ultrawide band frequency range BW.

Figure 4A:
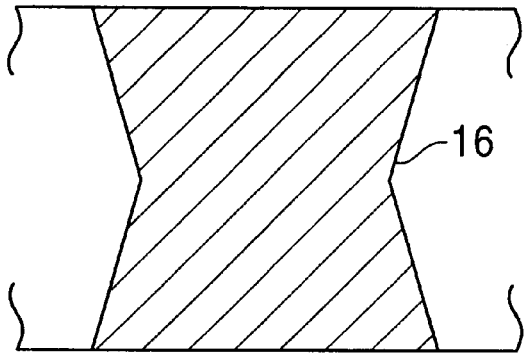
FIGS. 4A, 4B, 4C, and 4D are cross-sectional views showing the constructions of other planar dielectric structures in which negative-phase characteristics can be obtained in the ultrawide-band frequency range.
Figure 5A:
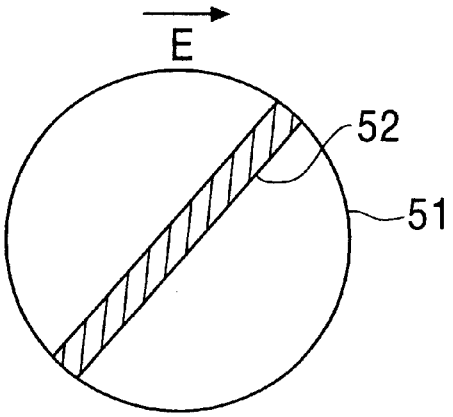
FIG. 5A PRIOR ART
FIGS. 5A and 5B are cross-sectional views showing the construction of a first known linear-circular polarization converter.
Figure 5B:
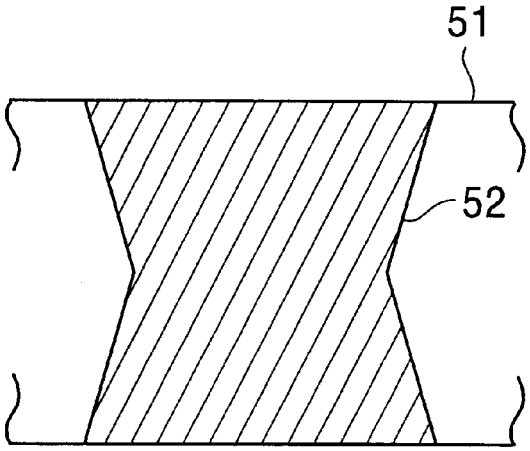
FIG. 5B PRIOR ART
Figure 6A:
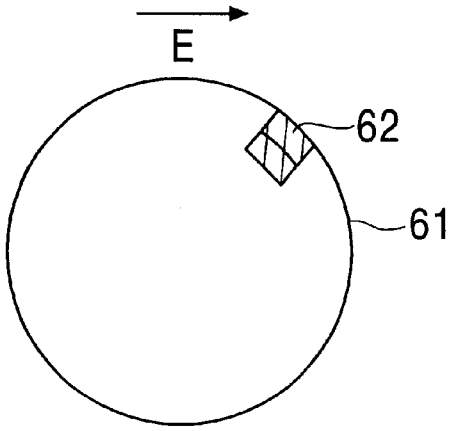
FIG. 6A PRIOR ART
FIGS. 6A and 6B are cross-sectional views showing the construction of a second known linear-circular polarization converter.
Figure 6B:
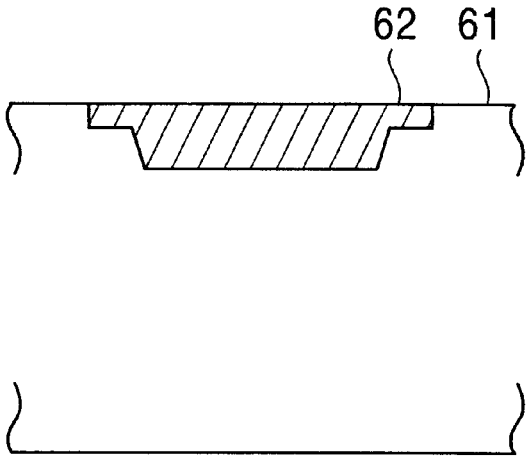
FIG. 6B PRIOR ART

In this case, a planar dielectric structure 16 shown in FIG. 4A, which is identical to the planar dielectric structure 52 shown in FIG. 5B, has both side faces thereof extending in the longitudinal direction cut inwardly in a generally triangular shape.

Figure 4B:
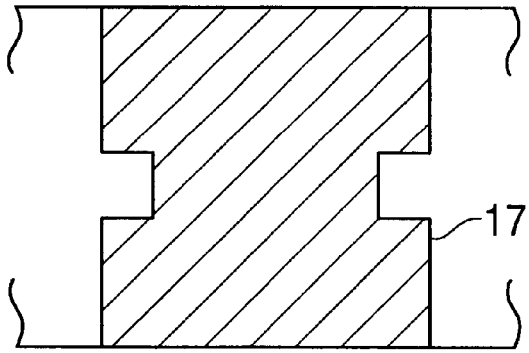

A planar dielectric structure 17 shown in FIG. 4B has both side faces thereof extending in the longitudinal direction cut inwardly in a generally rectangular shape.

Figure 4C:
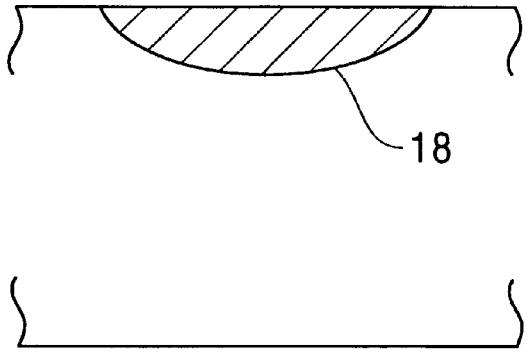

A planar dielectric structure 18 shown in FIG. 4C is provided at one side of the inner wall of a waveguide, and the height of the dielectric structure 18 in the longitudinal direction thereof is varied in a circular manner.

Figure 4D:
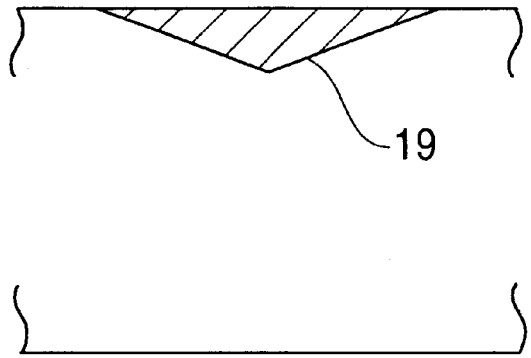

A planar dielectric structure 19 shown in FIG. 4D is provided at one side of the inner wall of a waveguide, and the height of the dielectric structure 18 in the longitudinal direction thereof is varied in a triangular manner.

Instead of using the planar dielectric structure 2 in FIGS. 1B and 1C, by using the planar dielectric structure 16, 17, 18, or 19 having the construction shown in FIGS. 4A, 4B, 4C, or 4D, the positive-phase characteristics shown in FIG. 2C may be also obtained in the ultrawide band frequency range BW.

In each embodiment described above, the examples in which the elliptic waveguides 1, 11, and 13 are employed as a waveguide for obtaining the negative-phase characteristics as shown in FIG. 2B over the ultrawide-band frequency range BW are described. However, in the present invention, waveguides enabling the above negative-phase characteristics to be obtained are not limited to those elliptic waveguides. Noncircular waveguides apart from elliptic waveguides, such as rectangular waveguides or their analog, may obtain such negative-phase characteristics.

As described above, according to the present invention, by combining the noncircular waveguide having negative-phase characteristics and the dielectric structure having positive-phase characteristics which complement the negative-phase characteristics, the following advantages are obtained: the ultrawide-band linear-circular polarization converter can be caused to have generally flat frequency-versus-phase characteristics which enable favorable linear-circular polarization conversion to be performed in the ultrawide-band frequency range; and the ultrawide-band linear-circular polarization converter can be obtained, having a simple construction, without causing an increase in manufacturing cost or the like.

What is claimed is:

1. An ultrawide-band linear-circular polarization converter comprising:

a waveguide having two orthogonal axes, which consist of a long axis and a short axis, in cross-section with different dimensions, the waveguide having negative-phase characteristics, wherein a phase of the long-axis and a phase of the short-axis have different phase delays as waves propagate through the waveguide in a direction of the long-axis and the short-axis, and a phase difference between the long-axis and the short-axis gradually decreases as a frequency increases within an ultrawide-band frequency range; and a dielectric member which extends along the short axis in the waveguide and which is arranged in a waveguide axis direction, the dielectric member having positive-phase characteristics, wherein the phase of the long-axis and the phase of the short-axis components have different phase delays as waves propagate through the dielectric member in the direction of the short-axis and the long axis, and the phase difference between the long-axis and the short-axis gradually increases as the frequency increases within the ultrawide-band frequency range, wherein complementary phase characteristics combining the negative-phase characteristics and the positive-phase characteristics are exhibited in accordance with an arrangement of the dielectric member.

2. An ultrawide band linear-circular polarization converter according to claim 1, wherein said waveguide is an elliptic waveguide in cross section of a waveguide passage.

3. An ultrawide-band linear-circular polarization converter according to claim 1, wherein:

the cross section view of the dielectric member comprise edge parts extending in the waveguide passage of said waveguide that are thinner than the middle portion between the edge parts of the member.

4. An ultrawide-band linear-circular polarization converter according to claim 1, wherein:

a ridged conductor structure is positioned at the inner wall of a noncircular waveguide in cross section of a waveguide passage.

5. An ultrawide-band linear-circular polarization converter according to claim 1, comprise:

the dielectric member positioned at one side of an inner wall of the waveguide such that, when measured from a top surface of the waveguide, a height of the dielectric member stays constant from left edge part to half way to middle portion, then increases and stays constant until half way close to the right edge, then decreases and stay constant, when viewed from a cross sectional view of the member.

6. An ultrawide-band linear-circular polarization converter according to claim 1, comprising:

the dielectric member having both sides faces extending in a longitudinal direction cut inwardly in a generally triangular shape when viewed from a cross sectional view of the member.

7. An ultrawide-band linear-circular polarization converter according to claim 1, comprising:

the dielectric member having both side faces extending in a longitudinal direction cut inwardly in a generally rectangular shape when viewed from a cross sectional view of the member.

8. An ultrawide-band circular polarization converter according to claim 1, when viewed from the cross sectional view of the waveguide comprising:

a semi-circular shaped dielectric member positioned at one side of an inner wall of the waveguide such that a height of the dielectric member, when measured from a top surface of the waveguide, increases from edge parts to the middle portion of the member.

9. An ultrawide-band linear-circular polarization according to claim 1, when viewed from the cross sectional view of the waveguide comprising:

a triangular shaped dielectric member positioned at one side of an inner wall of the waveguide such that a height of the dielectric member, when measured from a top surface of the waveguide, increases from the edge parts to the middle portion of the member.

* * * * *

UNITED STATES PATENT AND TRADEMARK OFFICE

CERTIFICATE OF CORRECTION

PATENT NO. : 6,624,715 B2
DATED : September 23, 2003
INVENTOR(S) : Dou Yuanzhu

It is certified that error appears in the above-identified patent and that said Letters Patent is hereby corrected as shown below:

Column 6,
Line 16, delete “ultrawide band” and substitute -- ultrawide-band -- in its place.
Line 30, delete “comprise:” and substitute -- comprising: -- in its place.
Line 41, after “both” delete “sides” and substitute -- side -- in its place.

Signed and Sealed this

Twenty-second Day of June, 2004

JON W. DUDAS
*Acting Director of the United States Patent and Trademark Office*